United States Patent [19]

Cooper et al.

[11] 3,997,163

[45] Dec. 14, 1976

[54] TARGET GAME

[75] Inventors: Julius Cooper, New Hyde Park; Edward Snyder, III, Dix Hills; Burt Ensmann, Flushing, all of N.Y.

[73] Assignee: Ideal Toy Corporation, Hollis, N.Y.

[22] Filed: Feb. 3, 1975

[21] Appl. No.: 546,226

[52] U.S. Cl. ..... 273/121 A; 273/119 A

[51] Int. Cl.[2] ..... A63F 7/00

[58] Field of Search ..... 273/118 A, 119, 122, 273/121, 127 R, 127 B, 89

[56] References Cited

UNITED STATES PATENTS

| | | | |
|---|---|---|---|
| 975,316 | 11/1910 | Barrett | 273/119 R X |
| 1,023,176 | 4/1912 | Schuster | 273/119 R |
| 1,422,383 | 7/1922 | Schumacher et al. | 273/89 |
| 2,830,819 | 4/1958 | Pearl | 273/121 A |
| 3,009,452 | 11/1961 | Barber et al. | 273/89 X |
| 3,578,802 | 5/1971 | Murphy et al. | 273/118 A X |

*Primary Examiner*—Paul E. Shapiro
*Attorney, Agent, or Firm*—Richard M. Rabkin

[57] ABSTRACT

A target game is disclosed in which a plurality of targets are mounted on a play surface and moved between exposed and concealed positions in an apparently random sequence. Projectiles, such as marbles or balls, are directed at the targets which can capture and retain projectiles that engage them. Retention of a projectile in the target will prevent the target from returning to its concealed position.

18 Claims, 6 Drawing Figures

TARGET GAME

The present invention relates to target games, and more particularly to a target game in which a plurality of targets are sequentially exposed during the play of the game.

Target games have been previously proposed in which a ball or projectile can be directed by a simulated gun or the like at a target on a play surface. Where the target is fixed on the play surface, the degree of difficulty in playing the game is relatively small since the player has an indefinite period of time in which to aim the projectile at the target. Thus the challenge and play value in such games is relatively slight. On the other hand, where moving randomly exposed targets are provided, the toy must be relatively complex and typically consists of an electronically controlled device, such as the shooting gallery games used in amusement parks, which provide a complicated auxiliary score mechanism to indicate that a particular target has in fact been hit.

It is an object of the present invention to provide a relatively simple parlor type target game in which projectiles can be directed at randomly exposed targets.

Another object of the present invetion is to provide a target type game in which a plurality of individual target members are moved in an apparently random sequence.

A further object of the present invention is to provide a target type game having moving targets, wherein the targets will be prevented from moving after being hit by a projectile.

A still further object of the present invention is to provide a target game which is relatively simple and inexpensive to manufacture.

Yet another object of the present invention is to provide a moving target type game which requires both skill and dexterity during play, thereby to provide a high degree of entertainment value.

In accordance with an aspect of the present invention the target type game includes a play surface on which a plurality of targets are pivotally mounted for movement between a first exposed position wherein the targets extend generally perpendicularly to the play and a second concealed position wherein the targets extend generally parallel to the play surface. A plurality of ball like projectiles are used in the game and are selectively projected towards the target along the play surface by projection means such as spring actuated simulated guns.

The targets are moved between their respective positions in an apparently random sequence by a drive mechanism so that the player or players must rapidly aim their projectiles before firing in order to hit the exposed target.

Each of the targets includes a pair of spaced leg members thereon which extend parallel to the play surface and towards the projection means for the projectiles when the target is in its exposed position. These leg members are spaced from each other a distance substantially equal to he diameter of the projectile in order to capture and retain a projectile which hits the targets. When a projectile is retained in a target it prevents the target from moving to its concealed position thereby to provide the players with an indication that the target has been properly hit. This will enable the players to keep score during the game. In addition, this arrangement allows a player, when the game is played with two players, to attempt to use his projectiles to disengage the captured projectile of this oppponent, thereby to reduce his opponent's score.

The above, and other objects, features and advantages of this invention, will be apparent in the following detailed description of an illustrative embodiment thereof which is to be read in connection with the accompanying drawings, wherein.

Figure 1:
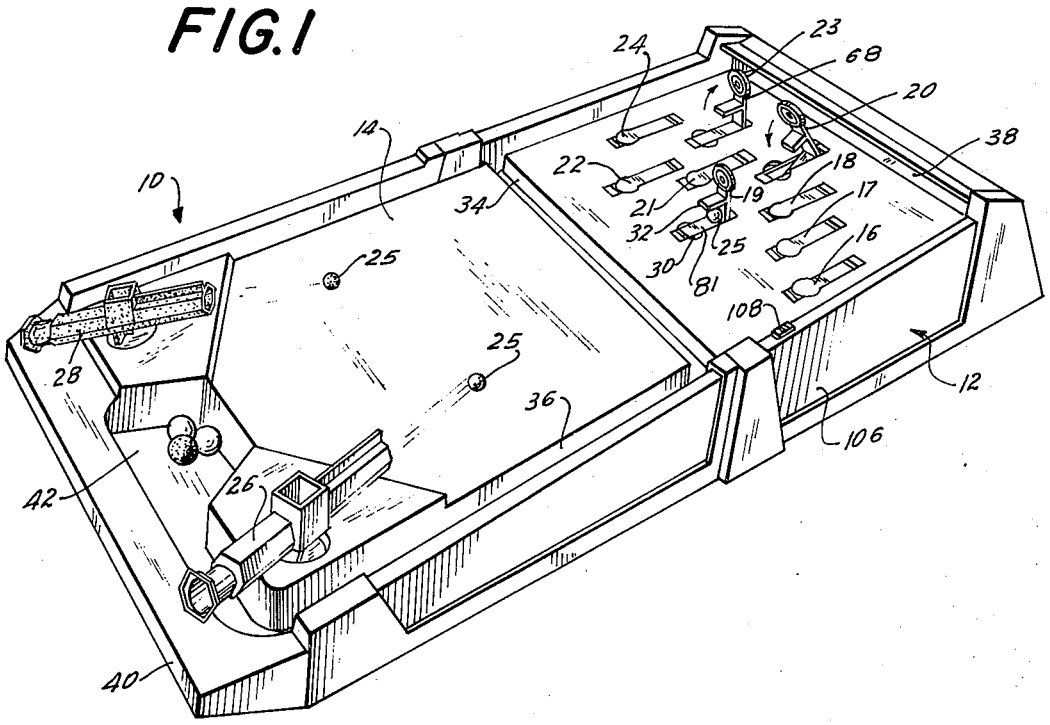
FIG. 1 is a perspective view of a target game constructed in accordance with an embodiment of the present invention.

Referring now to the drawings in detail, and initially to FIG. 1 thereof, it will be seen that a target game 10, constructed in accordance with the present invention, consists of a substantially unitary frame structure 12, formed of a conventional plastic material, having a play surface 14 on which a plurality of target members 16–24 are mounted. These targets are driven, as described hereinafter, to move in an apparently random sequence from a first exposed position (such as is shown with respect to target member 23 wherein the target member extends generally perpendicularly to the play surface 4) and a second concealed position (for example as shown with respect to target member 16). In their first positions the target members are exposed for engagement by projectiles, in the form of marbles or plastic balls 25, which are aimed and directed at the targets by the players with the projection means or simulated guns 26, 28.

If the projected balls 25 fail to hit the then exposed target, the target will be returned to its concealed position (as is illustrated for example with target 20 in FIG. 1) by the drive mechanism, while the next target in the sequence (target 23, for example as shown in FIG. 1) will be moved towards its exposed position. On the other hand, if an exposed target member is properly hit or engaged by a ball 25 the ball is captured between two legs 30, 32 formed on the target member and retained thereby (as illustrated for example with respect to target member 19). As described hereinafter, the mounting for the target member is such that when a ball 25 is retained between the legs 30, 32 the target member cannot be returned to its concealed position by the drive mechanism. In this manner, the target remains in substantially its exposed position so that, at the end of the game, the players can determine their respective scores. In addition, by keeping the ball and target exposed in this manner, an opponent can direct his projectiles at the captured ball in target 19 to remove his opponent's score from the game.

In accordance with a feature of the present invention, the target members are driven in their apparently random sequence through a predetermined time period so that at the end of this time period movement of the targets stops and the players can determine their score by counting the number of targets held in their exposed position by balls captured therein. In this connection it is noted that preferably the balls 25 are provided in two sets of differentiated colors, so that each player will project only his own colored balls with his own similarly colored simulated gun 26 or 28.

As seen most clearly in FIG. 1, the play surface 14 is inclined from a lower position adjacent the guns 26, 28 upwardly towards the targets 16–24. In addition, the play surface has a guide trough or recess 34 which extends across a median portion of the play surface and has a connecting leg or recess 36 along one side of the frame 12. The projectiles 25 are normally projected at the targets with sufficient force to move across the trough 34 without interference. However when any projectile 25 misses the targets, it engages the rear surface 38 of the frame 12 and rolls back down past the targets into the trough 34 and from there into the trough leg 36. The latter directs the balls toward the lower end 40 of the game into a common collection pocket 42 where the balls are available to the players for placement in the guns 26, 28 as described hereinafter.

Figures 2, 3:
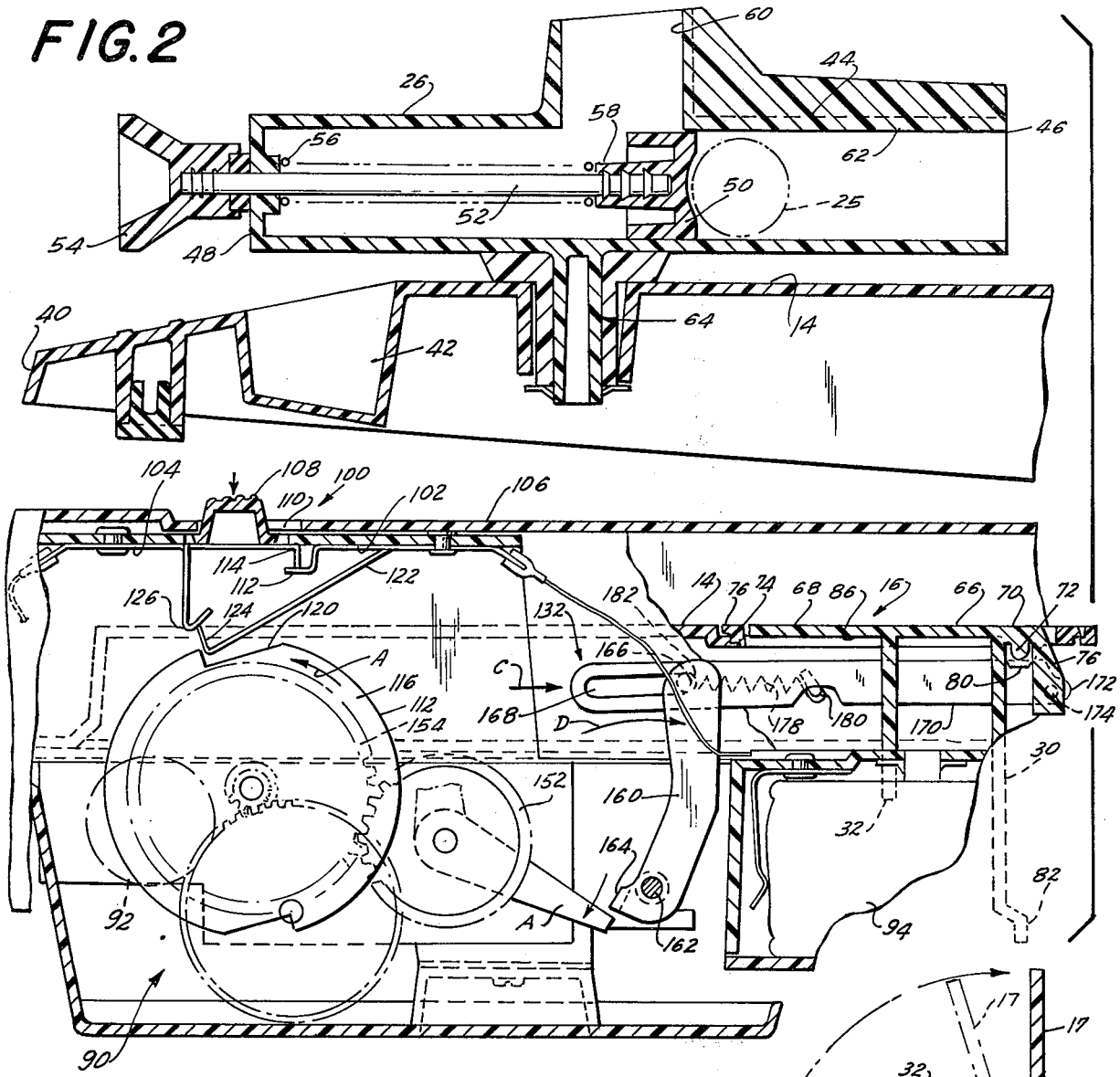
FIG. 2 is a sectional view taken generally along line 2—2 of FIG. 1, with parts broken away for clarity.
FIG. 3 is a side sectional view of one of the target members of the game, showing the target member in its exposed position, in solid lines, and substantially in the position it is held in when a projectile is captured therein.

The simulated guns or projection means 26, 28 are of identical construction (although they are preferably of different colors) and thus only one of the guns is disclosed in detail, in FIG. 2. As seen therein each of the guns includes a hollow housing 44 having an open end 46 facing the target members and an opposed closed end portion 48. A plunger 50 is slidably mounted in the housing and is secured to a steam or guide bar 52. The latter extends through the rear portion 48 of the housing and is secured to a pull member 54. A spring 56 is positioned between the rear wall 48 and the rear surface 58 of plunger 50, in order to bias the plunger into its forward position shown in FIG. 2. This forward position is limited by the engagement of pull member 54 against the rear wall 48 of the housing. In order to operate the gun 26, the player simply pulls member 54 rearwardly, against the bias of spring 56, to position the plunger 50 adjacent the rear wall 48. A ball 25 is then inserted in the gun through the upper opening 60 formed in housing 44 so that it drops into the bore 62 od the housing. The player then simply releases pull member 54 and spring 56 expands to move plunger 50 forwardly with a rapid impulse, thereby impelling the ball 25 out of the opened end of the housing and towards the targets.

In addition, housing 44 is pivotally mounted on the play surface 14 by a post and bushing assembly 64, in any convenient manner, so that the housing can be pivoted on the play surface in order that the gun can be directed at the various target members as they are moved into their exposed position.

Target members 16–24 are also of identical construction, and each consists of an essentially flat plate member 66 having a simulated target head portion 68 formed thereon (see FIGS. 1 and 2). The lower or rear end portion 70 of each target member includes a pair of integrally formed pivot pins 72 extending laterally outwardly therefrom (see FIGS. 3, 4 and 5) by which the targets are pivotally mounted in the play surface. In the illustrative embodiment of the invention an insert or support member 74 is secured on the lower surface of the play surface 14 in any convenient manner. This insert includes end step portions 76 which are secured on cooperating end or step portions 78 of the play surface 14 so that the inserts are fixed in position in and below the play surface. Each insert has a pair of pockets 80 formed therein (see FIGS. 2 and 5) which receive the pivot pin 72 and capture them in a relatively fixed position below the play surface 14. In this manner the target members can pivot from their concealed position shown in FIG. 2 to their exposed position, shown in FIG. 3 with respect to target 17, wherein they extend generally perpendicularly to the play surface 14.

The play surface 14 has a plurality of slots or openings 81 formed therein at which each of the target members are mounted. These openings are generally complementary in configuration to the flat portion 66 and the target 68 of the target members (See FIG. 4). The insert members 74 each have a generally rectangular slot 75 formed therein, with the width of the slot being slightly greater than the width of the target membr and its length being substantially equal to that of the target member. In this manner , the target member, in its concealed position, lies in substantially the same plane as the play surface 14 so that balls projected along the play surface will not be interfered with by any of the target members that are in their down or concealed positions.

Each of the target members includes a pair of integrally formed spaced leg members 30, 32 which, as mentioned above, extend towards the simulated guns 26, 28 when the target member is in its raised position (see FIG. 3). In the concealed position of the target members these legs extend through the slots 75, 81, as shown in FIG. 2, and are beneath the play surface. The legs 30 of the target members have a length which is substantially equal to the length of the slots 75, 81 and include a bent end portion 82 which engages the lower edge 84 of the insert 74 to define and limit the upper or exposed position to which the target members can be moved.

Figure 5:
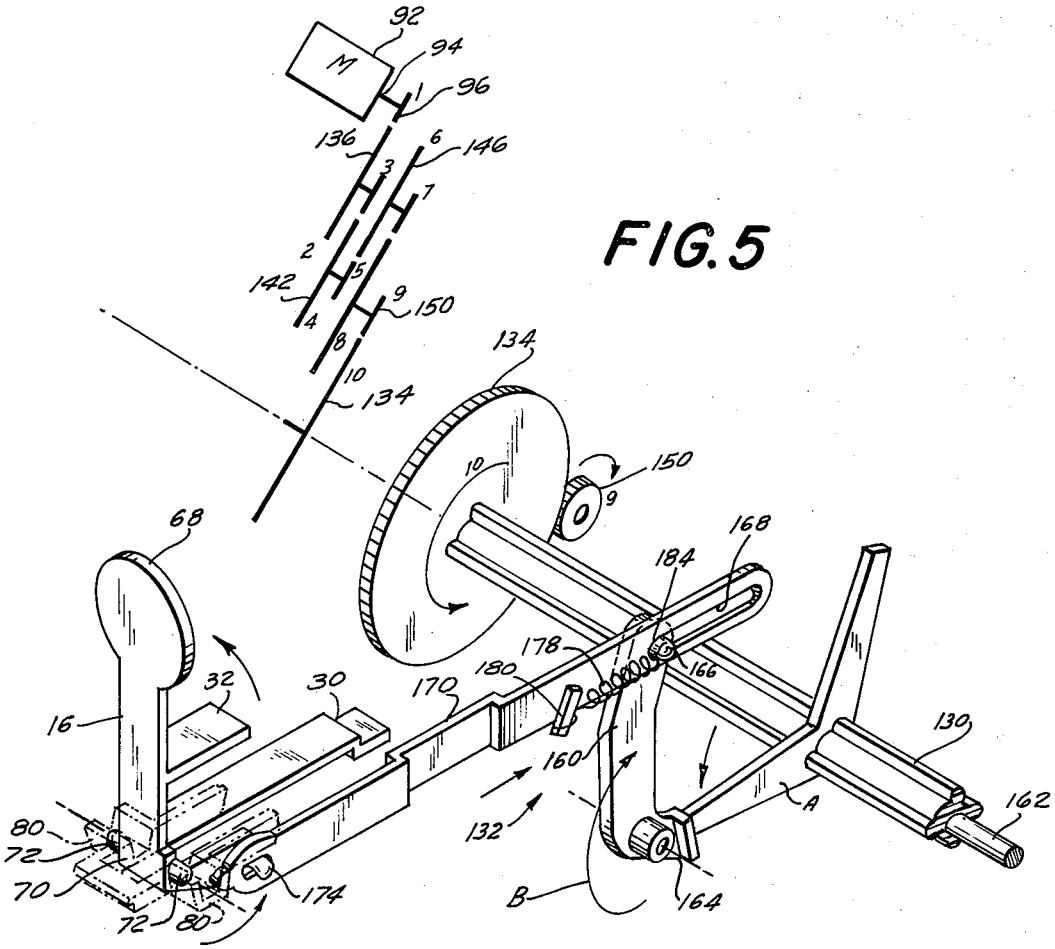
FIG. 5 is a perspective view of the drive mechanism for a typical target member in the game.
Figure 4:
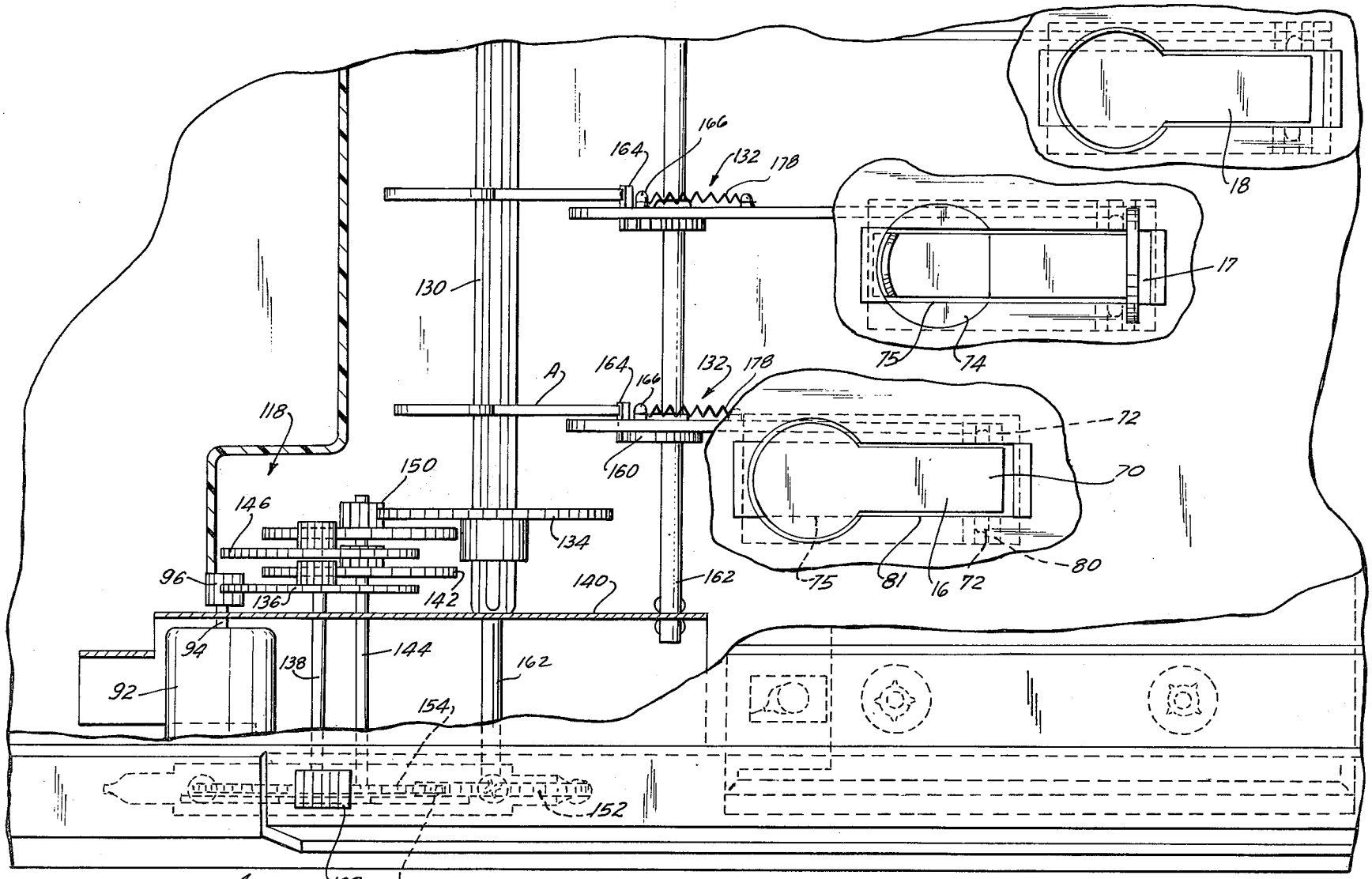
FIG. 4 is a partial plan view of the game illustrated in FIG. 1, with a portion of the play surface removed to expose the drive arrangement for the target members.

FIGS. 2, 4 and 5 illustrate in detail the drive mechanism 90 which is utilized in accordance with the present invention for moving the target members in their apparently random sequence. The drive mechanism includes a small electric motor 92 having an output shaft 94 on which is mounted a main spur gear 96 to provide all of the motive power for the device of the invention. The motor is supplied with current from one or more batteries 98 mounted in the frame 12 and connected to the motor 92 by a switch mechanism 100. The switch includes a pair of spring contact elements 102, 104 mounted in a side wall 106 of the frame 12. An actuating button 108 is vertically slidably mounted in an opening 110 formed in side wall 106 and rests on the end of the contact 104. The contact 102 has a free end 112 positioned below and in spaced relation to the end 114 of contact 104. By manually depressing the button 108, the contact ends 112, 114 are engaged and the motor 92 is operated.

A timing cam and switch operating member 16 is rotatably mounted in wall 106 and driven from spur gear 94 through a gear train 118 which forms part of the drive mechanism 90. The periphery of the timing member 116 has at least one recess 120 formed therein and is adapted to engage a resilient extension 122 of contact 102. This extension has a free end portion 124 which is positioned below an extension 126 of contact 104. By this arrangement, when the push button 108 is depressed, the motor 92 is operated and the cam 116 is rotated in the direction of the arrow A in FIG. 2. Rotation of the cam will cause its peripheral surface 128 to engage the contact extension 122 and hold it against the contact extension 126 so that the motor 92 continues to operate and the player can release the push button 108. Typically the players will know that the switch is held closed by the cam 116 after the button 108 is depressed, when the first target member is moved to its opened position.

The contact extensions 122, 124 are held in engagement by cam 116 until the recess 120 therein is returned, during rotation of the cam, to a position below the contact members. When that occurs, the resilient extension 122 of contact 102 enters recess 120 and returns to its solid line position in FIG. 2, thereby disengaging contact extension 126. Since the contact ends 112, 114 are no longer in engagement because button 108 had been previously released, the circuit between the battery and the motor is opened so that motor 92 is stopped and the targets are no longer moved.

By this arrangement, the targets are moved in their apparent random sequence during a predetermined time period established by the speed of rotation of the cam 116 and the number of recesses 120 in the cam surface. In the illustrative embodiment of the invention two diametrically opposed recesses 120 are formed in the cam so that the targets will be operated only during one half of a revolution of the cam. When the drive is stopped, as described above, the button 108 must be depressed again in order to initiate further movement of the target members.

In the preferred embodiment of the invention drive train 118 is selected such that the speed of rotation of cam member 116 is approximately one revolution every 2 minutes, thereby to provide play periods of 1 minute each during which the target members are moved between their exposed and concealed positions. At the end of each play period the players determine their score by counting the number of targets held in an open position by the players respective colored balls.

Figure 6:
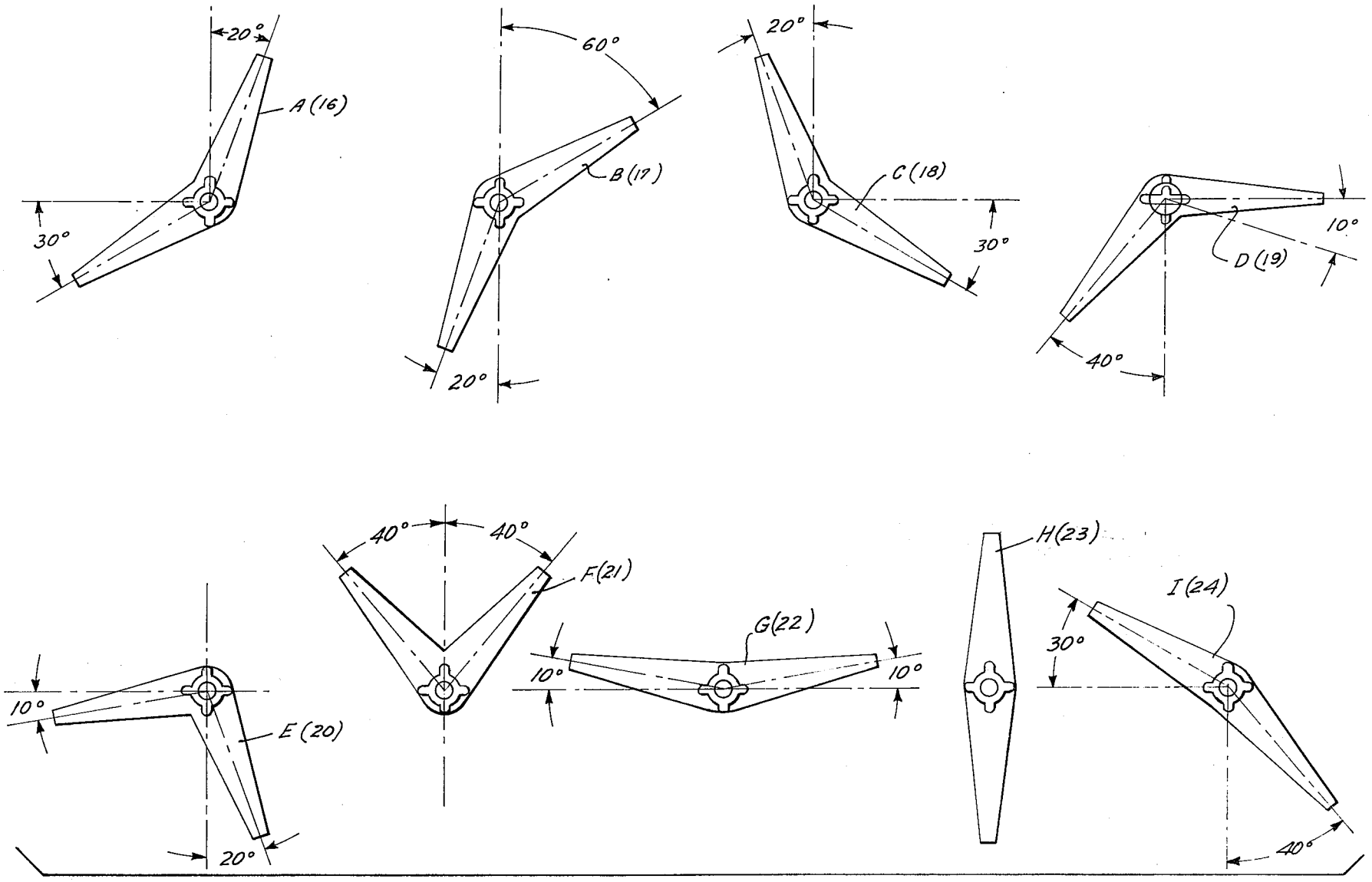
FIG. 6 is a plan view of the cam members associated respectively with the target members, for moving the target members in an apparently random sequence.

The drive mechanism 90 for the target members includes a main drive shaft 130 on which a series of cams A-I are rigidly mounted in association with each of the target members. (In FIG. 6 the reference number of the target member with which each cam is associated is shown in parenthesis). The cams each have a pair of angularly related cam or leg portions which are used to actuate an associated linkage 132 (See FIG. 5) that operatively connects the cam to the target member. The cams have the relative configurations illustrated in FIG. 6 and are mounted on the shaft 130 in axial alignment with respect to each other in the relative positions illustrated in FIG. 6. This arrangement is selected such that only one of the legs of any cam causes actuation of a target member at any instant in time. Thus only one target member will be in its raised position at any instant. Of course, however, it will be appreciated that other cam arrangements can be selected so that two or more target members will be in their exposed positions at any given moment in time.

The gear train 118 operatively connects the motor spur gear 94 to a spur gear 134 which is rigidly mounted on the shaft, in order to rotate the shaft during play of the game. The gear train 118 includes a series of compound gears including a first compound gear 136 which is freely rotatably mounted on a shaft 138. The latter is rotatably mounted in any convenient manner in a bracket 140, with the cam member 116 rigidly secured thereto for rotation with the shaft.

As seen most clearly in FIG. 4, the larger gear of the compound gear 136 is engaged with the spur gear 96 so as to be driven by motor 92, while its smaller gear is engaged with the larger gear of a second compound gear 142. This compound gear is rotatably mounted on a shaft 144, which is also freely rotatably mounted in the bracket 140. The smaller gear of compound gear 142 is in driving engagement with the larger gear of a third component gear 146; the latter also being freely rotatably mounted on shaft 138. The smaller gear of compound gear 146 engages the larger gear of a fourth compound gear 150, which also is freely rotatably mounted on the shaft 144. Finally, the smaller gear of the compound gear 150 engages the gear 134 to drive the shaft 130. In this manner, through the four compound gears, the speed of rotation of the motor is reduced so that the shaft 130 is driven at a relatively slow speed in order to operate and move the target members.

Shaft 130 is rotatably mounted in bracket 140, in any convenient manner, and includes at its end a spur gear 152. The latter is in driving engagement with a substantially larger spur gear 154 secured to or formed integrally with the cam member 116. In this manner, the drive of motor 92 is transmitted through shaft 130 and gears 152, 154 to the cam member. However, the gear 154 is at least twice as large (i.e., has at least two times the number of teeth) as the gear 152 so that it is rotated at at least half the speed of shaft 130.

Each of the linkages 132 which operatively connects the respective cam members A-I to their associated target members 16–24 includes an associated lever 160 which is pivotally mounted, in any convenient manner, on a shaft 162 mounted within frame 12. The levers each include a tab or cam engaging surface 164 which extends from the lower end thereof in position to be engaged by the ends of the legs of the cam member associated therewith. The upper end of the levers include integrally formed pin members 166 which are positioned within slots 168 formed in an associated link 170. The latter is pivotally connected at its rear end 172 by an integral pin 174 or the like with an extension 176 of the targer member. In addition, a tension or coil spring 178 is operatively connected at its ends 180, 182 to the link 170 and the pin 166 in order to bias the pin and lever into the position shown in FIG. 2, wherein pin 166 is at the end of the slot 168 nearest the target member.

By this arrangement, as seen most clearly in FIGS. 2 and 5, when shaft 130 is rotated the legs of the cam members A-I will be sequentially brought into engagement with the respective tabs 164 of their associated levers 160. Engagement of a leg of the cam with the lever 160 causes the lever to rotate in the direction of the arrows B in FIGS. 2 and 5. Because of the spring connection between the lever 160 and its associated link 170, such movement of the lever will pull the link 170 forwardly while the pin 166 remains engaged with the rear end 184 of the slot 168. The forward movement of the link thus causes the target member associated therewith to move from the concealed position thereof (FIG. 2) to the raised position illustrated in FIGS. 3 and 5. The target member is held in this position so long as the arm of its associated cam member is engaged with its associated cam tab 164. During this period of time, the players can project balls 25 at the target wherein they will become captured between the legs 30, 32 of the target if the target is hit. However, if the target is not hit, once the leg of the cam engaged with tab 164 passes away from the tab due to rotation of the shaft 130, the target is free to pivot back, in a counterclockwise direction in FIG. 3, to its original concealed position.

This movement of the target members will occur because of the gravitational bias provided to the target as a result of the configuration of leg 30 and the location of the pivot pins 72 of the target member. Such pivotal movement of the target member causes the pivotal connection 174 between the target member and the link 170, and thus the link 170 itself, to return to the right in the direction of the arrow C in FIG. 2. This also causes the lever 160 to pivot in a clockwise direction in the direction of the arrow D in FIG. 2, so that the assembly returns to its initial configuration wherein the tab 164 is positioned for engagement by the next leg of the cam associated therewith.

In the event that one of the players hits a target member when it is exposed, so that a ball 25 becomes trapped between the legs 30, 32, the target member is prevented from returning to is concealed position by the ball. This occurs because the dimensions of the slots 81 are selected so that the width of the slot is slightly less than the diameters of the balls 25. Thus the ball, in effect, blocks downward pivotal movement of the target member to its concealed position. However, some slight movement of the target towards its concealed position is allowed, as illustrated in phantom lines in FIG. 3, as the lower portion of the ball enters the slot before the sides of the slot engage the spherical surface of the ball. Thus the pivot 174 and the link 170 will move slightly to the right in FIG. 3 when a ball 25 is trapped in the target. In this position, should the cam associated with that target rotate sufficiently to cause the next leg of the cam member to engage the tab 164 on lever 160, the lever will be pivoted slightly in the direction of the arrow B indicated in FIG. 3. However, the link 170 cannot move because movement of the pivot pin 174 is prevented by the ball 25. As a result, the pin 166 will slide in slot 168 against the bias of spring 178. Thus the slot and spring arrangement 168, 178, provide a safety device which will prevent damage to the lever 160 or to the link 170 when a ball 25 is trapped in a target member.

As mentioned above, the cams A-I have predetermined relative configurations with respect to the angular relationship between their legs, and they are secured to or integrally formed with the shaft 130 in relative positions with respect to one another so that only one of the targets is moved to its exposed position at any moment in time. In addition, the pairs of legs of each of the cam members are in predetermined positions with respect to each other so as to provide a relatively long repetitive sequence to the movement of the target members. Thus, by using the cams having the configuration and relative positions with respect to each other illustrated in FIG. 6, the operating sequence for the target members will be as follows: F, B, G, D, C, I, E, H, D, D, A, E, G, I, F, C, H, A. The sequence will then repeat itself in the same order of presentation of target members associated with the respective cams. This long repetitive sequence makes the appearance of the target members in their exposed position seem to be random. Moreover, because of the drive arrangement for the shaft 130 and the timing cam 116, with the shaft 130 being driven at a different speed from that of the cam 116 (and in the illustrative embodiment at twice the speed) the device will be stopped by the timing cam at a different portion of the sequence during each successive operation of the device.

The random nature of the presentation of the target members is further enhanced due to the fact that in the preferred embodiment of the invention an odd number of target members are utilized, to insure that even if the drive ratio between the gear 152 and 154 is an even number, the game will be stopped by the timing cam at a different part of the sequence during each successive operation of the device. Thus, in effect, the target members are presented in a different sequence during each operation of the device so that the players cannot anticipate either the sequence of presentation of target members during a particular time period nor which target member will become exposed next during the play of the game.

Accordingly, it will be seen that in the play of the game each player is supplied with a number of the differently colored balls or marbles 25 at the beginning of the game. One of the players initially depresses the button 108, closing the contacts 102, 104 and holds the button depressed until one of the target members 17–24 is moved to its exposed position. At that point the button 108 is released, and the cam 116 has, by that time, been driven through a sufficient rotation to cause its surface 128 to hold the contacts 122, 126 in their closed position to allow continued operation of motor 92. Thereafter, the target members are moved between their exposed and concealed positions in an apparently random sequence as the players project their balls or marbles 25 at the target, in an attempt to have their marbles captured and retained between the legs 30, 32 of the target members. After a predetermine period of time (determined by the position of the recesses 120 in the periphery of cam member 116) the drive to the motor 92 is stopped and the players determine their score by counting the number of targets retaining marbles of the players selected color. Thus the object of the game is to obtain the greatest number of marbles captured in targets during the period of time provided by the cam member 116.

Accordingly, it will be appreciated that a relatively simply constructed parlor type target game is provided which requires a degree of skill in rapidly aiming the simulated gun members 26, 28 at the randomly moving targets. The game requires continuous action on the part of the players and the random movement of the target introduces an element of chance in the selection of the position of the gun members in order to direct the balls. As a result a highly entertaining and action filled game is provided.

Although an illustrative embodiment of the invention has been described herein with reference to the accompanying drawings, it is to be understood that the invention is not limited to that precise embodiment thereof, and that various changes and modifications may be effected therein by those skilled in the art without departing from the scope or spirit of this invention.

What is claimed is:

1. A target game comprising a play surface having a plurality of openings formed therein; a plurality of targets respectively associated with said openings and mounted on said play surface in their associated openings for movement between exposed and concealed positions with respect to said play surface, means for moving said targets between said exposed and concealed positions in an apparently random sequence; a plurality of projectiles; and means for directing said projectiles at said targets; said targets including means for capturing and retaining a projectile engaging the target, and said projectiles having a maximum dimension which is larger than the maximum width dimension of said openings thereby to cooperate with said openings in said play surface and prevent movement of the targets from their exposed to their concealed positions when engaged in the capturing and retaining means of the target.

2. The game as defined in claim 1 wherein said target members are pivotally mounted on said surface for movement between a first exposed position wherein the target is positioned to extend generally perpendicularly to said surface and a second concealed position wherein the target lies generally parallel to said surface.

3. The game as defined in claim 2 wherein said targets are mounted in said openings to lie in substantially the same plane as said play surface in their second position.

4. The game as defined in claim 3 wherein the width of said opening is less than the maximum dimension of the projectiles whereby movement of the target to its second concealed position is prevented when a projectile is captured in the capturing and retaining means of the target.

5. The game as defined in claim 1 wherein said capturing and retaining means comprises a pair of spaced parallely extending legs on said target directed generally towards said means for directing projectiles at the targets, said legs being spaced a distance substantially equal to the maximum dimension of the projectiles to capture and retain a projectile therebetween.

6. The game as defined in claim 1 wherein said means for moving the targets includes timing means for controlling operation of the moving means to a predetermined period of time.

7. The game as defined in claim 1 wherein said moving means includes a plurality of cam members respectively associated with and operatively connected to said target members for moving the target members between said exposed and concealed positions.

8. The game as defined in claim 7 wherein said moving means include a motor for rotating said cams, a rotary timing cam for controlling the operation of the motor to a predetermined time period and a gear train between said motor and cam for driving the timing cam at a different rotary speed then the speed then the remainder of the cams.

9. A target game comprising a play surface having a plurality of slots formed therein; a plurality of targets respectively associated with said slots, said targets being pivotally mounted on said play surface in said slots for movement between a first exposed position wherein the targets extend generally parallel to the play surface and a second concealed position wherein the targets extend generally parallel to the play surface; a plurality of ball-like projectiles; at least one means mounted on said play surface for selectively projecting said ball-like projectiles at said targets; means for pivoting said targets between said first and second positions in an apparently random sequence; said targets including a pair of spaced leg members thereon extending parallel to said play surface towards said projecting means in the first position of the target whereby in the second position of the target said leg members extend through the slots below the play surface; said leg members being spaced from each other a distance substantially equal to the diameter of said ball-like projectiles to capture and retain a projectile engaging the target; said leg members and slots having a width which is less than the diameter of said projectiles whereby when a projectile is captured between the leg members of a target the projectile will prevent the target from returning to its second position and will hold the target in approximately its first position.

10. The target game as defined in claim 9 wherein said targets each include a target portion extending generally perpendicularly to said play surface in the first position of the target and having a lower end pivotally connected to said play surface; said leg members extending generally perpendicularly from said target portion adjacent the pivotal connection thereof to said play surface towards said projecting means and having sufficient weight to normally pivotally bias said target members to their second position under the influence of gravity and said moving means comprises means for moving the targets from their second to their first position and then releasing the target members to allow them to return to their second position under the influence of gravity.

11. The target game as defined in claim 9 wherein said moving means includes a motor, a plurality of cam members driven by said motor and respectively operatively connected to said targets for moving the targets between first and second positions, said cam members each having cam surfaces arrayed angularly with respect to each other to move said target members in a predetermined and apparently random sequence.

12. The target game as defined in claim 11 including timing means for limiting operation of said motor to a predetermined period of time, said timing means being substantially independent of the rotation of said cams to stop the motor at a different point in said apparently random sequence in successive operations of the motor.

13. The target game as defined in claim 12 wherein said motor is an electric motor and said timing means includes a switch having closable contacts for controlling operation of the motor, a timing cam having a cam surface positioned to normally engage and close said contacts, said timing cam being driven by said motor and having at least one recessed surface portion in its cam surface for allowing the switch contacts to open when the recessed surface portion is adjacent the contacts.

14. The target game as defined in claim 13 including a gear train operatively connecting said motor to said timing cam and the other of said cams for rotating the timing cam and the other cams at different speeds of rotation.

15. The target game as defined in claim 14 including manually operable means for closing said switch contacts until said surface portion of the timing cam recessed surface is moved away from the switch contacts by operation of the motor.

16. The target game as defined in claim 11 including individual actuating links having first and second end portions and being respectively associated with said targets; said first end portion of each link being pivotally connected to its associated target; a plurality of levers respectively associated with said cams and actuating links and being pivotally mounted in said game adjacent their associated cams for engagement thereby, said levers being operatively engaged with the second end portion of their associated actuating links for moving the links and thus pivoting said targets in response to rotation of said cams.

17. The target game as defined in claim 16 wherein said second end portion of each of said links has an elongated slot formed therein; said levers each have a connecting pin slidable in the slot of its associated lever; and individual spring means operatively engaged between each of said pins and levers for biasing the pin to the position in the slot closest to the target member associated therewith, thereby to form a flexible operative connection between the cams and the targets.

18. The target game as defined in claim 11 including a pair of said projecting means mounted on said play surface, each of which includes a housing, a plunger slidably mounted in the housing between retracted and extended positions and spring means biasing the plunger to the extended position thereof.

* * * * *